United States Patent [19]

Wood, Jr.

[11] 4,128,072

[45] Dec. 5, 1978

[54] POWER BOAT HULL

[75] Inventor: Garfield A. Wood, Jr., Monroe, La.

[73] Assignee: Woodstream Corporation, Lititz, Pa.

[21] Appl. No.: 779,845

[22] Filed: Mar. 21, 1977

[51] Int. Cl.[2] ..... B63B 1/20

[52] U.S. Cl. ..... 114/291; 9/6 R; 114/56

[58] Field of Search ..... 9/6; 114/56, 291, 288; D12/62

[56] References Cited

U.S. PATENT DOCUMENTS

| | | | |
|---|---|---|---|
| 2,980,924 | 4/1961 | Canazzi | 114/291 X |
| 3,237,581 | 3/1966 | Moesly | 114/56 |
| 3,363,598 | 1/1968 | Mortrude | 114/56 X |

*Primary Examiner*—Trygve M. Blix
*Assistant Examiner*—Sherman D. Basinger
*Attorney, Agent, or Firm*—Woodcock, Washburn, Kurtz & Mackiewicz

[57] ABSTRACT

A power boat hull having sides and a bottom formed of a series of vertically stepped panels disposed symmetrically on either side of the hull center line. The series of panels on either side of the hull center line include an inboard panel, a center panel and an outboard panel. Vertical risers join the adjacent edges of the center and outboard panels and extend substantially parallel to the hull center line. Vertical risers join the adjacent edges of the center and inboard panels and extend on opposite sides of the hull center line from the stern to a point of intersection on the center line adjacent the bow. The panels are angled upwardly from the horizontal, outwardly of the hull center line with such angularities decreasing between successive panels in the outboard direction at all stations along the length of the hull except at the stern, the angularities of each inboard and center panels increasing from the stern toward the bow while the angularities of the outboard panels remain constant.

5 Claims, 7 Drawing Figures

POWER BOAT HULL

BACKGROUND OF THE INVENTION

Power boats of the general type to which the present invention is directed are known in the trade as bass boats. One of the most popular hulls for a bass boat is the "deep-V" hull, the bottom of which comprises essentially a single panel on either side of the center line or keel of the hull extending to the chine. The bottom has constant dead rise of 21° to 23° of angle from the horizontal. It usually has two stabilizing strips on each side of the keel. However, the deep-V hull requires high horse power for efficient performance, is unstable at low speeds and at rest and, because of deep draft, will not operate in shallow water. The standard V hull requires considerably less power for efficient operation than the "deep-V" and will operate in shallow water. However, it is a notoriously rough rider and has become less popular because of this. Another popular prior art hull is the ABF hull which is a modified deep-V hull with a center pad. The bottom pad panel on either side of the pad has a constant dead rise of 17° and the pad is essentially flat. The ABF hull will operate in shallow water, however, it requires high horse power for efficient performance. A typical ABF hull design is manufactured by Delhi Manufacturing Corporation, Delhi, La. under the model designation Terry American Bass Fisherman (Terry ABF) and is described in the article "There's A New Breed of Bass Boat: The High-Stepping High Performers" by Dave Ellison, Bassmaster Magazine, November/December, 1975, pages 42–51 along with other similar high performance bass boats having a deep or semi-V hull and bottom running pad. Another type of prior art boat hull which requires high horse power for efficient performance is disclosed in Moesly U.S. Pat. No. 3,237,581.

SUMMARY OF THE INVENTION

It is an object of the present invention to provide an improved power boat hull which obtains highly efficient performance with less horsepower and without the need of power trim which adds several hundred dollars to the cost of the motor in any horsepower range. Thus, it is an object of the invention to provide a less expensive power boat and motor combination, both from an initial standpoint and from subsequent operational costs. It is a further object of the invention to provide an extremely stable hull both while running at all speeds and at rest. It is a still further object of the invention to provide a hull which will operate in extremely shallow water and still give a soft ride. Thus it will be seen that it is an object of the invention to provide a new and improved boat hull which incorporates the best features of the previously described prior art hulls while minimizing the objectionable features.

In accordance with the present invention there is provided a power boat hull having sides and a bottom, the bottom being formed of a series of vertically stepped panels disposed symmetrically on either side of the hull center line, the series of panels on either side of the hull center line including an inboard panel, a center panel and an outboard panel. Vertical risers join the adjacent edges of the center and outboard panels and extend substantially parallel to the hull center line. Vertical risers join the adjacent edges of the center and inboard panels and extend on opposite sides of the hull center line from the stern to a point of intersection on the center line adjacent the bow. The panels are angled upwardly from the horizontal, outwardly of the hull center line with such angularities decreasing between successive panels in the outboard direction at all stations along the length of the hull except at the stern, the angularities of each of the inboard and center panels increasing from the stern toward the bow while the angularities of the outboard panels remain constant.

More particularly, in a power boat hull according to the present invention, the angularities of the panels at stations disposed along the length L of the hull from the stern to the bow are in accordance with the following table where A equals 5° and B equals 0° to 5° but is constant for any particular hull:

| Stations | Stern | ¼ L | ½ L | ¾ L | ⅞L |
|---|---|---|---|---|---|
| Inboard Panel | A + B | 1.5A + B | 2A + B | 5A + B | 11A + B |
| Center Panel | A + B | 1.3A + B | 1.6A + B | 3A + B | 5A + B |
| Outboard Panel | A + B | A + B | A + B | A + B | A + B |

DETAILED DESCRIPTION

Figure 1:
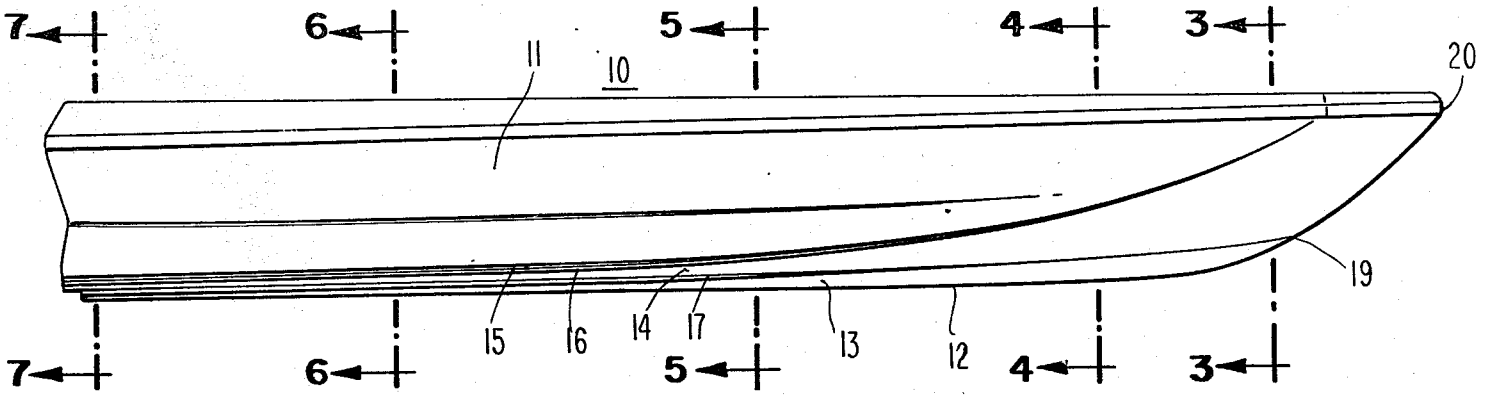
FIG. 1 is a side elevation of a power boat hull embodying the present invention.
Figure 2:
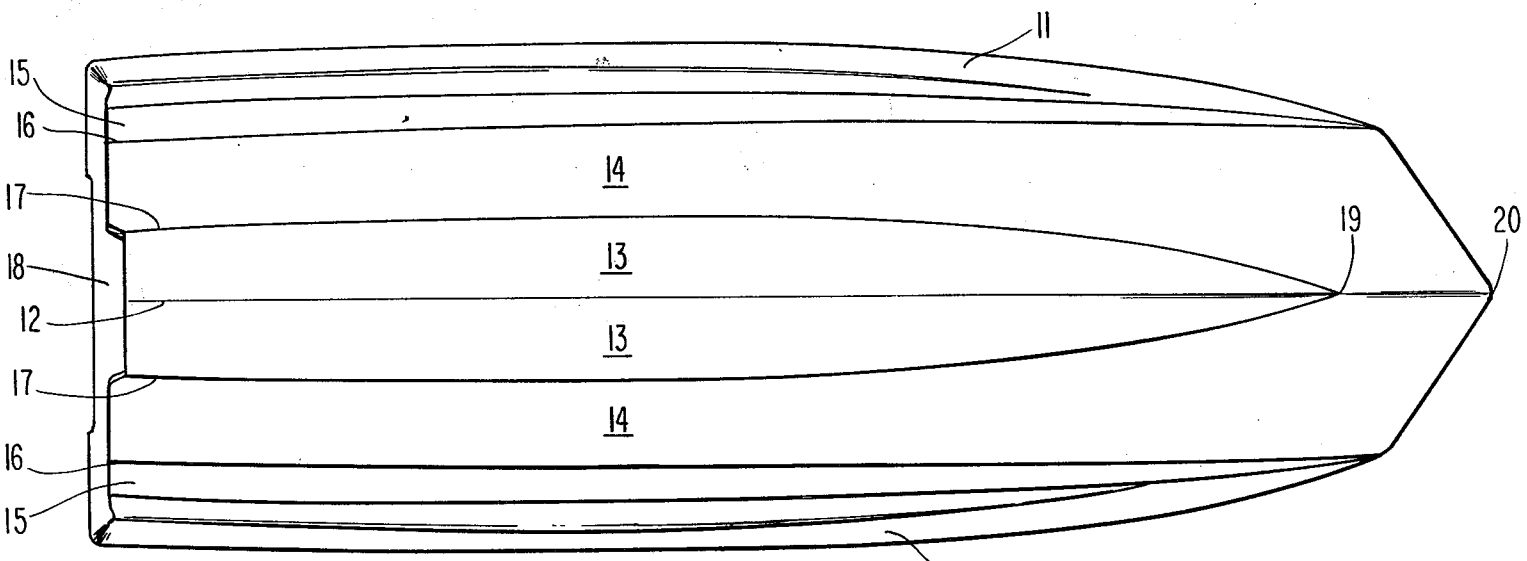
FIG. 2 is a bottom plan view of the power boat hull shown in FIG. 1.

Referring to the drawings, FIGS. 1 and 2, it will be seen that the hull 10 is of a type which may be referred to as a hard chine semi-V hull. The hull 10 has sides 11 and a bottom formed of a series of vertically stepped panels disposed symmetrically on either side of the hull center line 12, FIG. 2. The series of panels on either side of the hull center line include an inboard panel 13, a center panel 14 and an outboard panel 15. Vertical risers 16 join the adjacent edges of the center and outboard panels 14 and 15 and extend substantially parallel to the hull center line 12. Vertical risers 17 join the adjacent edges of the center and inboard panels 14 and 13 and extend on opposite sides of the hull center line 12 from the stern or transom 18 to a point of intersection 19 on the center line 12 adjacent the bow 20.

Figure 3:
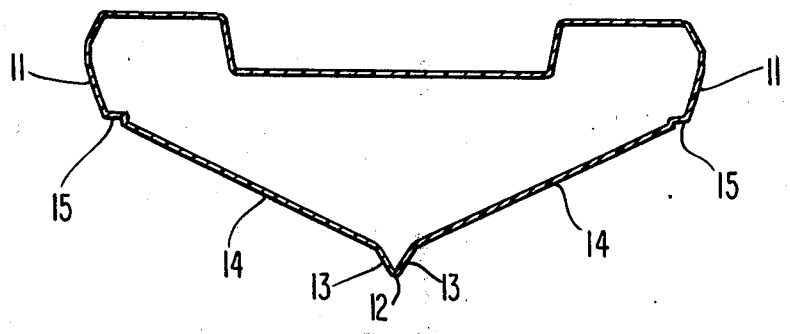
FIGS. 3–7 are sectional views taken along the lines 3–7 in FIG. 1 which correspond to stations at specified intervals along the length of the boat hull.
Figure 4:
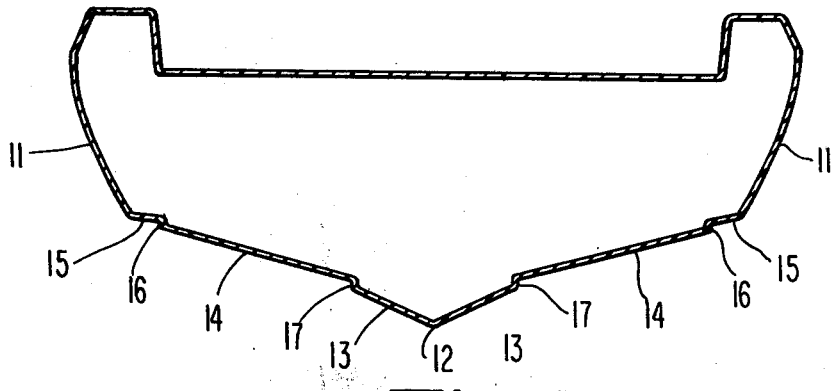
Figure 5:
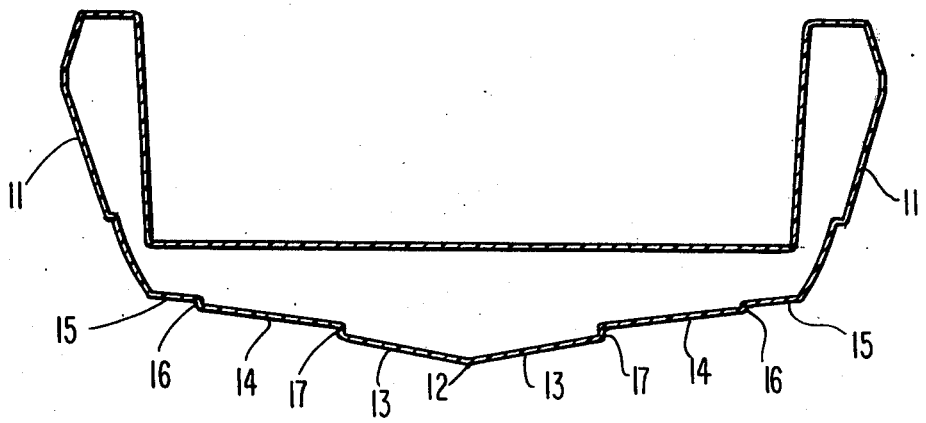
Figure 6:
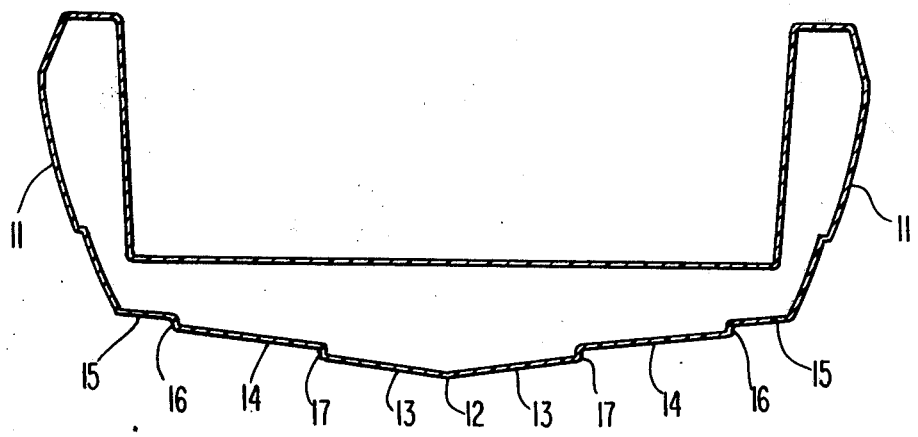
Figure 7:
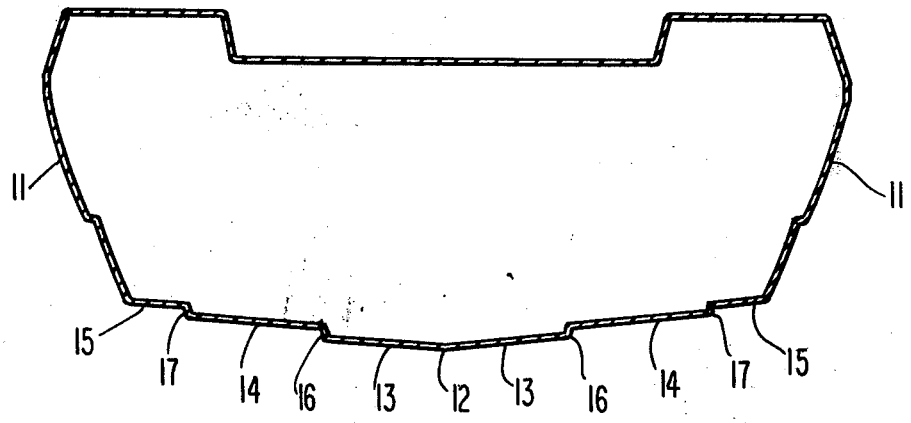

As may be seen in FIG. 1 the hull 10 has been divided into five sections or stations along its length L. The section starting at the transom 18 is illustrated in FIG. 7, the section one-quarter forward, i.e., ¼ L is shown in FIG. 6, the section one-half forward, i.e., ½ L is shown in FIG. 5, the section three-quarters forward, i.e., ¾ L is shown in FIG. 4, and the section seven-eighths forward, i.e., ⅞ L is shown in FIG. 3. As may be seen in FIGS. 3–7 the inboard running surface 13 increased from a relatively flat angle at the transom 18, FIG. 7 to an extremely high angle at the forward station, FIG. 3. This sharp bow angle provides easy entrance into waves and acts as a shock absorber for soft riding qualities. The secondary running surface, i.e., center panels 14 adjacent to the inboard surfaces 13, increase from the same flat angle of the inboard surfaces at the transom 18 to a medium-high angle at the forward station in FIG. 3. These surfaces are the load carrying members and will support the hull high in the water while running, particularly with motors of low horsepower. The outboard panels 15 or chine surfaces which maintain the same relatively flat angle the entire bottom length of the hull are not running surfaces but are designed to stabilize the hull at rest. For this reason, the deadrise angle of these panels 15 remains constant.

The foregoing is illustrated in the following table where the angularities of the panels (deadrise in degrees off horizontal) at the stations disposed along the length L of the hull from the stern, FIG. 7, to the bow, FIG. 3, are in accordance with the following table where A = 5° and B = 0° to 5° but is constant for any particular hull:

Table I

| Stations | Stern | ¼ L | ½ L | ¾ L | ⅞ L |
|---|---|---|---|---|---|
| Inboard Panel | A + B | 1.5A + B | 2A + B | 5A + B | 11A + B |
| Center Panel | A + B | 1.3A + B | 1.6A + B | 3A + B | 5A + B |
| Outboard Panel | A + B | A + B | A + B | A + B | A + B |

In a preferred example of a hull designed in accordance with the above table A was 5° and B was 0° thus producing the angularities of the panels at the stations disposed along the length L of the hull from the stern to the bow in accordance with the following:

| Stations | Stern | ¼ L | ½ L | ¾ L | ⅞ L |
|---|---|---|---|---|---|
| Inboard Panel | 5° | 7.5° | 10° | 25° | 55° |
| Center Panel | 5° | 6.5° | 8° | 15° | 25° |
| Outboard Panel | 5° | 5° | 5° | 5° | 5° |

Tests were conducted on boat hulls constructed in accordance with the preferred embodiment. The boat hulls had an overall length of 460 cm (15 feet 1 inches) a beam at the transom of 162.6 cm (5 feet 4 inches) and an extreme beam of 167.6 cm (5 feet 6 inches). With the hull constructed as a wooden running plug having a hull weight of 465 lbs., a transom height of 21½ inches and powered with a 75 horsepower Johnson Stinger motor with power trim and a 21 inch stainless steel (SST) propeller, the following performance was obtained:

| | RPM | Indicated Speed MPH |
|---|---|---|
| 1 person (175#) 1 fuel tank 1 battery | 6200 | 49.5 |
| Added 100#60# fwd. 40# aft | 6100 | 48.5 |
| Added 2nd person (200#) | 6050 | 48.0 |
| Added 120# aft | 6000 | 47.0 |
| 21" aluminum propeller | | |
| 1 person 60# fwd. 40# aft weights | 6400 | 48.0 |

The foregoing test was run to determine a proper weight distribution for the hull. Half speed turns showed excellent handling and smooth action. No ventilation was noted on any run and the close speed attained between the cupped SST propeller and the standard aluminum propeller with similar loadings (48.5 SST vs. 48.0 aluminum) indicated that raising the motor on the transom by approximately ¾ inch with the SST propeller would result in a speed of close to 50 miles per hour.

A similar test was conducted with a boat having a fiber glass hull and deck made in accordance with the preferred embodiment. The glass hull had the same length (460 cm) and beam dimensions as the wooden hull described in the above example. However, it had a hull weight of 565#, a transom height of 21½ inches and was powered by a 55 horsepower Evinrude motor with power trim and a 17 inch SST propeller. The following is the performance data from this glass hull:

| | RPM | Indicated Speed MPH |
|---|---|---|
| 1 person (175#) 1 fuel tank 1 battery | 6500 | 41.0 |
| Added 2nd person (200#) | 6400 | 40.0 |
| Filled livewells added 2nd fuel tank | 6300 | 39.0 |
| 19" Aluminum Propeller | | |
| 1 person 1 fuel tank 1 battery | 6100 | 40.0 |
| Added 2nd person | 6050 | 39.5 |

The glass hull with the midrange horsepower motor showed excellent acceleration getting out of the "hole" and on to a plane in approximately 3 seconds. At the best performing trim, it was found that the performance at all speeds and loadings was at the same setting thus indicating no need or advantage for power trim with this motor. Tight turns made at top speed showed no bucking or slipping. No ventilation was noted with the aluminum non-cupped propeller, indicating that the SST cupped propeller may be raised by at least ¾ inch over the 21½ inch transom height which should result in an increased speed of approximately 2 miles per hour. The boat handled and ran smoothly at all speeds and would hold in a plane down to 15 miles per hour.

Another test was run on the glass hull with a 35 horsepower Johnson motor and a 13 inch aluminum propeller. This test gave the following results:

| | RPM | Indicated Speed MPH |
|---|---|---|
| 1 person (175#) 1 fuel tank 1 battery | 6400 | 32.0 |
| 2 persons (300#) | 6350 | 31.0 |
| 3 persons (485#) | 6300 | 30.0 |

With this low range horsepower motor the 460 cm hull still showed fine acceleration even with three persons riding. The boat ran smoothly at all speeds and maintained a plane as low as 10 miles per hour. No ventilation was noted under any type of handling or loading. Use of the SST cupped propeller with transom height raised ¾ inch from the normal transom height of 21½ inch should result in an approximate speed increase of 2 miles per hour. The boat was run in choppy conditions (approximately 1½ ft. chop) and it was soft riding.

A boat having a glass hull constructed in accordance with the preferred embodiment of this invention and having a length of 460 cm was tested against an ABF glass hull having a constant deadrise at 17° and a center pad. The ABF hull has a length of 4.7 m and was approximately 50# heavier than the 460 cm hull of the present invention. The following is a table showing a comparison of the two hulls with different horsepower engines and with power trim and without trim.

| Horsepower with power trim | Horsepower without trim | 460 cm MPH | ABF 4.7 m MPH |
|---|---|---|---|
| 85 | | | 50.0 |
| | 85 | | 44.0 |
| 75 | | 48.0 | 46.0 |
| | 75 | 47.0 | 40.0 |
| 55 | | 42.0 | |
| | 55 | 42.0 | |
| | 35 | 32.0 | |

From the above table it will be seen that the ABF hull with an 85 horsepower motor with power trim attained a speed of 50 MPH and without trim it had a speed of 44 MPH. The 460 cm hull has a maximum horsepower rating of 75 horsepower and thus was not tested with the 85 horsepower engine. However, it will be noted that with a 75 horsepower motor with power trim the 460 cm boat attained a speed of 48 MPH where the ABF boat only attained a speed of 46 MPH. With a 75 horsepower motor without trim the difference in speed was more drastic. The 460 cm boat attained a speed of 47 MPH whereas the ABF boat only attained a speed of 40 MPH. The ABF boat will not run with a motor smaller than 75 horsepower. However, the 460 cm boat with a 55 horsepower motor with power trim attained a speed of 42 MPH and also attained the same speed with the 55 horsepower motor without power trim. This is a particularly desirable result since power trim adds approximately $350.00 to the cost of the motor in any horsepower range. Thus it will be seen that a boat hull constructed in accordance with the present invention enables the owner to attain relatively good performance speed from the boat and with a relatively low horsepower motor without the additional expense of power trim. The above table also shows that with a relatively small motor of only 35 horsepower without power trim the 460 cm boat constructed in accordance with the present invention obtained a speed of 32 MPH.

The above table shows a comparative performance between the new hull (460 cm) constructed in accordance with the present invention and the prior ABF 4.7 m hull which is only slightly larger and carries a horsepower rating of 90 compared to 75 for the new hull. The ABF 4.7 m is considered to be one of the best performing hulls in the high-performance bass boat tradition. While the speed of the ABF 4.7 m is excellent with power trim, performance is considerably less when power trim is not used. The speed of the 460 cm hull remains constant, or nearly so with or without power trim.

While the above test results were obtained with a boat hull constructed in accordance with Table I where A = 5° and B = 0° it is expected that equally good results will be obtained with hulls where B is increased to 3° or even to 5°. The following table shows the deadrise in degrees off horizontal where A = 5° and B = 3°:

| Stations | Stern | ¼ L | ½ L | ¾ L | ⅞ L |
|---|---|---|---|---|---|
| Inboard Panel | 8° | 10.5° | 13° | 28° | 58° |
| Center Panel | 8° | 9.5° | 11° | 18° | 28° |
| Outboard Panel | 8° | 8° | 8° | 8° | 8° |

The following example shows the deadrise in degrees off horizontal where A = 5° and B = 5°:

| Stations | Stern | ¼ L | ½ L | ¾ L | ⅞ L |
|---|---|---|---|---|---|
| Inboard Panel | 10° | 12.5° | 15° | 30° | 60° |
| Center Panel | 10° | 11.5° | 13° | 20° | 30° |
| Outboard Panel | 10° | 10.0° | 10° | 10° | 10° |

While the above examples of power boat hulls have involved hulls made of wood and fiberglass, it is to be understood that the invention is not limited to hulls made of such materials but is also applicable to other materials including metals such as aluminum and the like. It is further to be understood that while a preferred embodiment of the boat hull of the present invention has been described and illustrated, various changes and modifications may be made therein without departing from the spirit of the invention and within the scope of the appended claims.

What is claimed is:

1. A power boat hull having sides and a bottom, said bottom being formed of a series of vertically stepped panels disposed symmetrically on either side of the hull center line, said series of panels on either side of the hull center line including an inboard panel and a center panel and an outboard panel, vertical risers joining the adjacent edges of said center and outboard panels, vertical risers joining the adjacent edges of said center and inboard panels and extending on opposite sides of the hull center line from the stern to a point of intersection on the center line adjacent the bow to provide soft riding qualities, said panels being angled upwardly from the horizontal outwardly of the hull center line with such angularities decreasing between successive panels in the outboard direction at all stations along the length of the hull except at the stern, the angularities of each said inboard and center panels increasing from the stern toward the bow while the angularities of said outboard panels remain constant thereby stabilizing the hull both while running at all speeds and at rest.

2. A power boat hull according to claim 1 wherein the angularities of said panels at stations disposed along the length L of the hull from the stern to the bow are in accordance with the following table where A = 5° and B = 0° to 5° but is constant for any particular hull:

| Stations | Stern | ¼ L | ½ L | ¾ L | ⅞L |
|---|---|---|---|---|---|
| Inboard Panel | A + B | 1.5A + B | 2A + B | 5A + B | 11A + B |
| Center Panel | A + B | 1.3A + B | 1.6A + B | 3A + B | 5A + B |
| Outboard Panel | A + B | A + B | A + B | A + B | A + B |

3. A power boat hull according to claim 1 wherein the angularities of said panels at stations disposed along the length L of the hull from the stern to the bow are in accordance with the following table:

| Stations | Stern | ¼ L | ½ L | ¾ L | ⅞ L |
|---|---|---|---|---|---|
| Inboard Panel | 5° | 7.5° | 10° | 25° | 55° |
| Center Panel | 5° | 6.5° | 8° | 15° | 25° |
| Outboard Panel | 5° | 5° | 5° | 5° | 5° |

4. A power boat hull according to claim 1 wherein the angularities of said panels at stations disposed along the length L of the hull from the stern to the bow are in accordance with the following table:

| Stations | Stern | ¼ L | ½ L | ¾ L | ⅞ L |
|---|---|---|---|---|---|
| Inboard Panel | 8° | 10.5° | 13° | 28° | 58° |
| Center Panel | 8° | 9.5° | 11° | 18° | 28° |
| Outboard | | | | | |

-continued

| Stations | Stern | ¼ L | ½ L | ¾ L | ⅞ L |
|---|---|---|---|---|---|
| Panel | 8° | 8° | 8° | 8° | 8° |

5. A power boat hull according to claim 1 wherein the angularities of said panels at stations disposed along the length L of the hull from the stern to the bow are in accordance with the following table:

| Stations | Stern | ¼ L | ½ L | ¾ L | ⅞ L |
|---|---|---|---|---|---|
| Inboard Panel | 10° | 12.5° | 15° | 30° | 60° |
| Center Panel | 10° | 11.5° | 13° | 20° | 30° |
| Outboard Panel | 10° | 10.0° | 10° | 10° | 10° |

* * * * *